US010675490B2

(12) United States Patent
Blondeau

(10) Patent No.: US 10,675,490 B2
(45) Date of Patent: Jun. 9, 2020

(54) STRAP FORMING A BELT AND/OR PAIR OF THIGH STRAPS OF A ROPING HARNESS, AND ROPING HARNESS

(71) Applicant: ZEDEL, Crolles (FR)

(72) Inventor: Loïc Blondeau, La Tronche (FR)

(73) Assignee: ZEDEL, Crolles (FR)

( * ) Notice: Subject to any disclaimer, the term of this patent is extended or adjusted under 35 U.S.C. 154(b) by 84 days.

(21) Appl. No.: 15/196,660

(22) Filed: Jun. 29, 2016

(65) Prior Publication Data

US 2016/0375278 A1 Dec. 29, 2016

(30) Foreign Application Priority Data

Jun. 29, 2015 (FR) ..... 15 56055

(51) Int. Cl.
*A62B 35/00* (2006.01)
*D03D 3/00* (2006.01)
*D07B 1/22* (2006.01)

(52) U.S. Cl.
CPC ..... *A62B 35/0006* (2013.01); *A62B 35/0025* (2013.01); *D03D 3/005* (2013.01); *D07B 1/22* (2013.01)

(58) Field of Classification Search
CPC ..... D03D 1/0005; D03D 1/0094; D03D 2700/02; D03D 7/00; D03D 13/00
USPC ..... 182/3–9
See application file for complete search history.

(56) References Cited

U.S. PATENT DOCUMENTS 3,978,894 A * 9/1976 Boone ..... D03D 1/0005 139/383 R
5,183,703 A * 2/1993 Berger ..... B60R 22/12 139/383 R
5,202,177 A * 4/1993 Kamper ..... A62B 35/04 139/384 R
5,436,044 A * 7/1995 Pinkos ..... B60P 7/0869 139/383 R
6,085,802 A * 7/2000 Silberberg ..... A62B 35/04 139/387 R
6,199,597 B1 * 3/2001 David ..... D03D 1/0005 139/22
6,533,066 B1 * 3/2003 O'Dell ..... A62B 35/04 182/3
8,038,584 B1 * 10/2011 Pruessner ..... A61H 1/02 482/143
8,136,555 B1 * 3/2012 Chang ..... D03D 1/0005 139/383 R (Continued)

FOREIGN PATENT DOCUMENTS

EP 1834543 A1 9/2007
EP 2383018 A1 11/2011

(Continued)

*Primary Examiner* — Daniel P Cahn
(74) *Attorney, Agent, or Firm* — Oliff PLC

(57) ABSTRACT

A strap includes at least a first and second area, the first and second areas being consecutive along a longitudinal axis of the strap. The strap is woven from at least the first, second and third groups of warp threads and at least one weft thread, the strap being devoid of the second group in the second area, and of the third group in the first area, the first group passing through the first and second areas. The first group and second group of warp threads are distributed over the width of the strap in the first area.

21 Claims, 6 Drawing Sheets

Fig. 6b

(56) References Cited

U.S. PATENT DOCUMENTS

2002/0067031 A1* 6/2002 Busgen ..... B60R 21/18 280/733
2003/0056846 A1* 3/2003 Buesgen ..... B60R 21/18 139/1 R
2003/0111127 A1* 6/2003 Kikuchi ..... D03D 1/0005 139/409
2005/0056335 A1* 3/2005 Tielemans ..... D03D 1/0005 139/383 A
2005/0217748 A1* 10/2005 Ikegami ..... A62B 35/04 139/388
2006/0027277 A1* 2/2006 Jennings ..... A62B 35/04 139/408
2006/0124470 A1* 6/2006 Zama ..... F16F 15/005 205/317
2007/0209869 A1* 9/2007 Martin ..... A45F 3/12 182/6
2007/0267084 A1* 11/2007 Pereira ..... D03D 1/00 139/116.1
2008/0139066 A1* 6/2008 Shimazaki ..... B60R 22/12 442/189
2008/0182471 A1* 7/2008 Danzey ..... B66C 1/18 442/199
2008/0229558 A1* 9/2008 Martin ..... A62B 35/0037 24/455
2008/0296037 A1* 12/2008 Burland ..... H02G 3/0487 174/36
2009/0023352 A1* 1/2009 Russell ..... A62B 35/04 442/182
2009/0134690 A1* 5/2009 Shimazaki ..... D03D 1/0005 297/475
2009/0223587 A1* 9/2009 Berger ..... D03D 1/0005 139/11
2009/0224521 A1* 9/2009 Huber ..... D03D 1/02 280/743.1
2009/0288731 A1* 11/2009 Chang ..... D03D 1/08 139/383 R
2010/0129597 A1* 5/2010 Hansen ..... B32B 5/26 428/107
2010/0248574 A1* 9/2010 King ..... D03D 11/00 442/205
2011/0061519 A1* 3/2011 Fields ..... A63B 29/02 87/2
2011/0180175 A1* 7/2011 Krumm ..... D03D 5/00 139/383 R
2011/0309226 A1* 12/2011 Auston ..... E04G 21/3238 248/364
2012/0071793 A1* 3/2012 Gal ..... A61B 5/1135 600/595
2012/0161376 A1* 6/2012 Hede ..... A62B 35/0075 267/73
2013/0017746 A1* 1/2013 Auktun ..... C09J 7/048 442/149
2013/0056302 A1* 3/2013 Bishop ..... A62B 35/0025 182/3
2014/0113519 A1* 4/2014 Golz ..... D02G 3/442 442/190
2014/0174641 A1* 6/2014 Roman ..... D03D 13/004 156/182
2014/0256202 A1* 9/2014 Laurent ..... D06H 5/002 442/181
2014/0273697 A1* 9/2014 Russell ..... D03D 1/0094 442/206
2014/0345743 A1* 11/2014 He ..... D03D 3/02 139/348 R
2015/0007905 A1* 1/2015 Le Boulicaut ..... D03D 11/02 139/11
2015/0013079 A1* 1/2015 Golz ..... A62B 35/0075 8/638
2015/0143634 A1* 5/2015 Beaulieu ..... A61G 1/01 5/626
2015/0231424 A1* 8/2015 Kim ..... A62B 35/04 182/3
2015/0299522 A1* 10/2015 Lodde ..... C09J 7/045 428/220
2015/0337490 A1* 11/2015 Burdette, III ..... D07B 1/12 428/34.5
2016/0304751 A1* 10/2016 Mussig ..... C09J 7/255
2016/0305050 A1* 10/2016 Winner ..... D03D 41/004
2016/0309843 A1* 10/2016 Song ..... A43B 23/0205
2016/0367845 A1* 12/2016 Bouquier ..... A62B 35/0075
2016/0375278 A1* 12/2016 Blondeau ..... A62B 35/0006 182/3
2017/0189172 A1* 7/2017 Grundeman ..... A61F 2/2412

FOREIGN PATENT DOCUMENTS

FR 2371533 A1 6/1978
FR 3007994 A1 1/2015
WO 02/28482 A1 4/2002

* cited by examiner

STRAP FORMING A BELT AND/OR PAIR OF THIGH STRAPS OF A ROPING HARNESS, AND ROPING HARNESS

BACKGROUND OF THE INVENTION

The invention relates to a strap enabling a belt and/or a thigh strap or a pair of thigh straps of a roping harness to be produced, and to a roping harness made from such a strap.

STATE OF THE ART

Roping harnesses form part of the indispensable equipment in the field of work at height or sporting activities such as rock climbing, mountaineering, glacier hiking, or backcountry skiing. They make it possible to work or to pursue this type of sports activity in complete safety.

In rock climbing and for work at height, the weight and compactness of the roping harness are not characteristics of prime importance as the user does not have to carry all of his equipment when pursuing his activity.

However, in mountaineering, glacier hiking, or backcountry skiing, the sports person has to carry all of his equipment on him. This can represent a large weight and volume. Every gram gained in comparison with existing equipment therefore constitutes an effort appreciated by the user.

However, the gain in weight and compactness must not be achieved to the detriment of user comfort and safety.

OBJECT OF THE INVENTION

An object of the invention consists in providing a strap having the particularity of being compact and light and enabling for example a belt and/or a thigh strap or a pair of thigh straps to be formed, designed to be integrated in a comfortable and safe roping harness.

For this purpose, the strap comprises at least a first area and at least a second area, the first and second areas being consecutive along a longitudinal axis of the strap.

The strap also comprises at least a first group of warp threads, a second group of warp threads different from the first group of warp threads and a third group of warp threads different from the first and second groups of warp threads.

The strap is further woven by means of the first, second and third groups of warp threads and at least one weft thread. The strap is advantageously devoid of the second group of warp threads in the second area, and of the third group of warp threads in the first area, the first group of warp threads passing through the first and second areas. The first group of warp threads and the second group of warp threads can be distributed over the width of the strap in the first area.

In one embodiment, the first group of warp threads and the second group of warp threads can be uniformly distributed in the orthogonal direction to the longitudinal axis of the strap in the first area.

According to one feature of the invention, the strap can comprise at least a third area comprising the first, second and third groups of warp threads.

Furthermore, the first area can be wider than the second area in an orthogonal direction to the longitudinal axis of the strap.

The first group of warp threads can comprise first warp threads made from polyamide or from polyethylene having at least 100,000 monomers per molecule and a molar mass approximately equal to $3\times10^6$ g/mol. The second group of warp threads can for its part comprise second warp threads which are monofilaments made from a material having a base formed by polyester, polyamide or polypropylene. Finally, the third group of warp threads can comprise third warp threads made from polyester having at least 100,000 monomers per molecule.

According to one embodiment, the first group of warp threads can mainly comprise first warp threads made from a first material. The second group of warp threads can mainly comprise second warp threads made from a second material different from the first material. The third group of warp threads can mainly comprise third warp threads made from a third material different from the first material and from the second material.

The third warp threads can further cover the first warp threads in the second area, and at least the second area can be associated with an adjustment device of a roping harness.

The second area can advantageously be configured to collaborate with a loop of the adjustment device.

The strap further comprises at least first and second weft threads made from different materials, the first area being mainly formed with the first weft thread and the second area being mainly formed with the second weft thread.

According to one feature of the invention, the first weft thread can be a monofilament made from a material having a base formed by polyester, polyamide or polypropylene. The second weft thread can for its part be made from polyamide or from polyester having at least 100,000 monomers per molecule.

The invention also relates to a roping harness having a belt and/or a thigh strap, possibly a pair of thigh straps, and/or a chest strap or a pair of chest straps, made from a strap comprising the above-mentioned features.

The roping harness can comprise at least one adjustment device of the thigh strap and/or of the belt, the adjustment device being fixed to two second areas separated by a first area.

The roping harness can furthermore comprise ends of the threads forming the second group of warp threads at one of the edges of the second area, i.e. at a junction between a second area and a first or third area.

The harness can also comprise ends of the threads forming the third group of warp threads at one of the edges of the first area, i.e. at a junction between a first area and a second or third area.

According to one embodiment of the roping harness, the latter can comprise an additional strap woven by means of the second group of warp threads or of a part of the second group of warp threads and starting at one of the edges of the second area, i.e. at a junction between a second area and a first or third area, to form an equipment holder and/or to collaborate with an adjustment device.

The roping harness can also comprise an additional strap woven by means of the third group of warp threads or a part of the third group of warp threads and starting at one of the edges of the first area, i.e. at the junction between a first area and a second or third area, to form an equipment holder and/or to collaborate with an adjustment device.

Finally, an embodiment of the roping harness can comprise a belt formed by a first strap comprising the above-mentioned features, and at least one of the thigh straps can be formed by a second strap and be terminated by a connecting strap in a second area, the connecting strap being sewn onto a second area of the belt.

BRIEF DESCRIPTION OF THE DRAWINGS

Other advantages and features will become more clearly apparent from the following description of particular embodiments of the invention given for non-restrictive example purposes only and represented in the appended drawings, in which.

DETAILED DESCRIPTION

Figure 1:
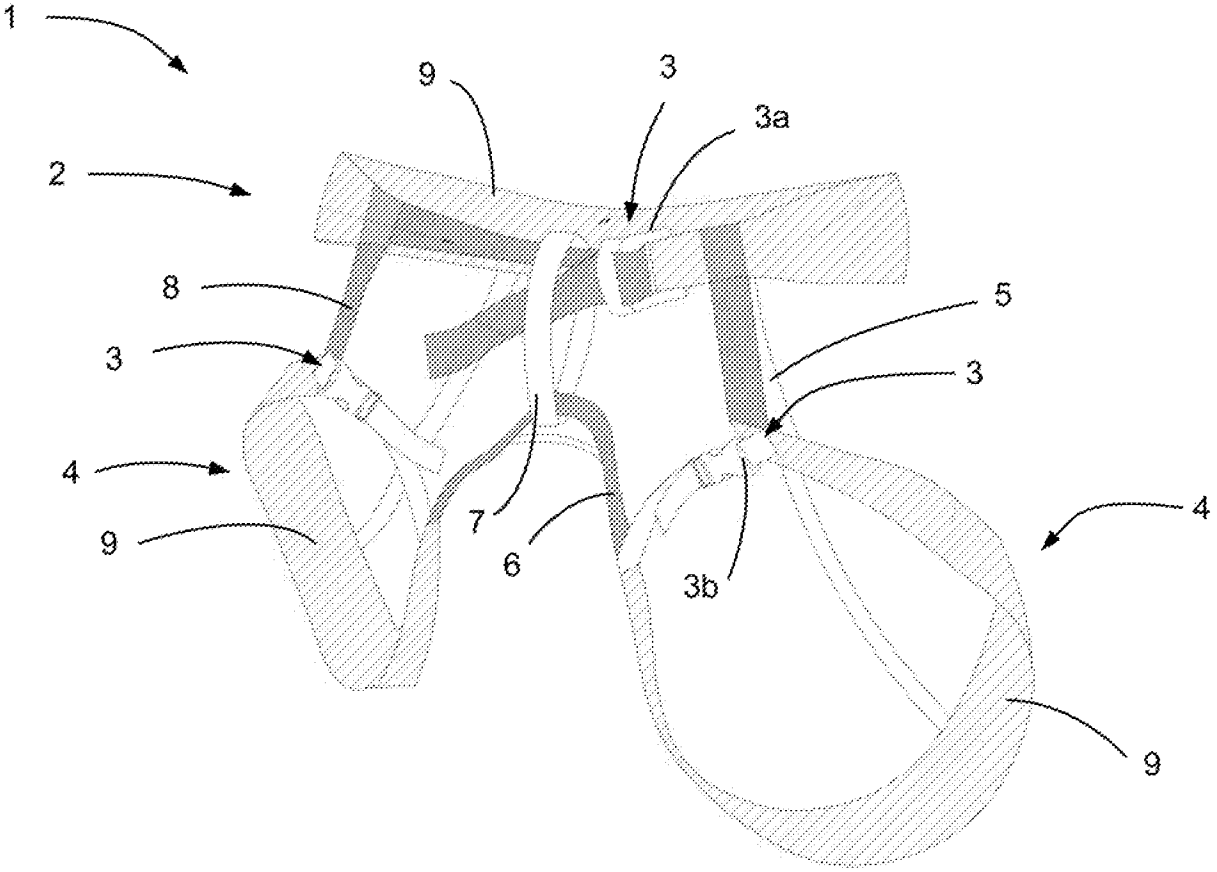
FIGS. 1 to 3 illustrate different embodiments of a roping harness in schematic manner.
Figure 2:
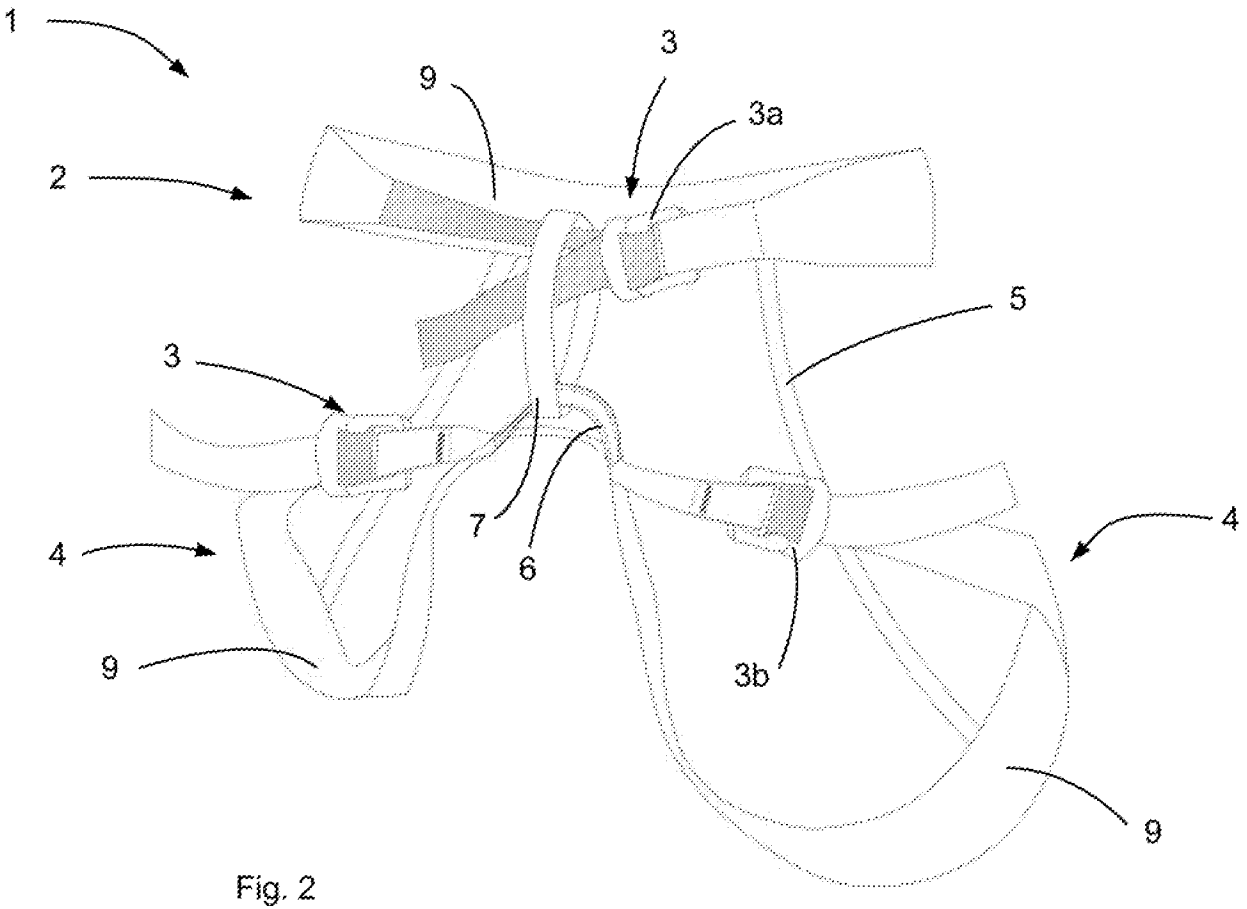
Figure 3:
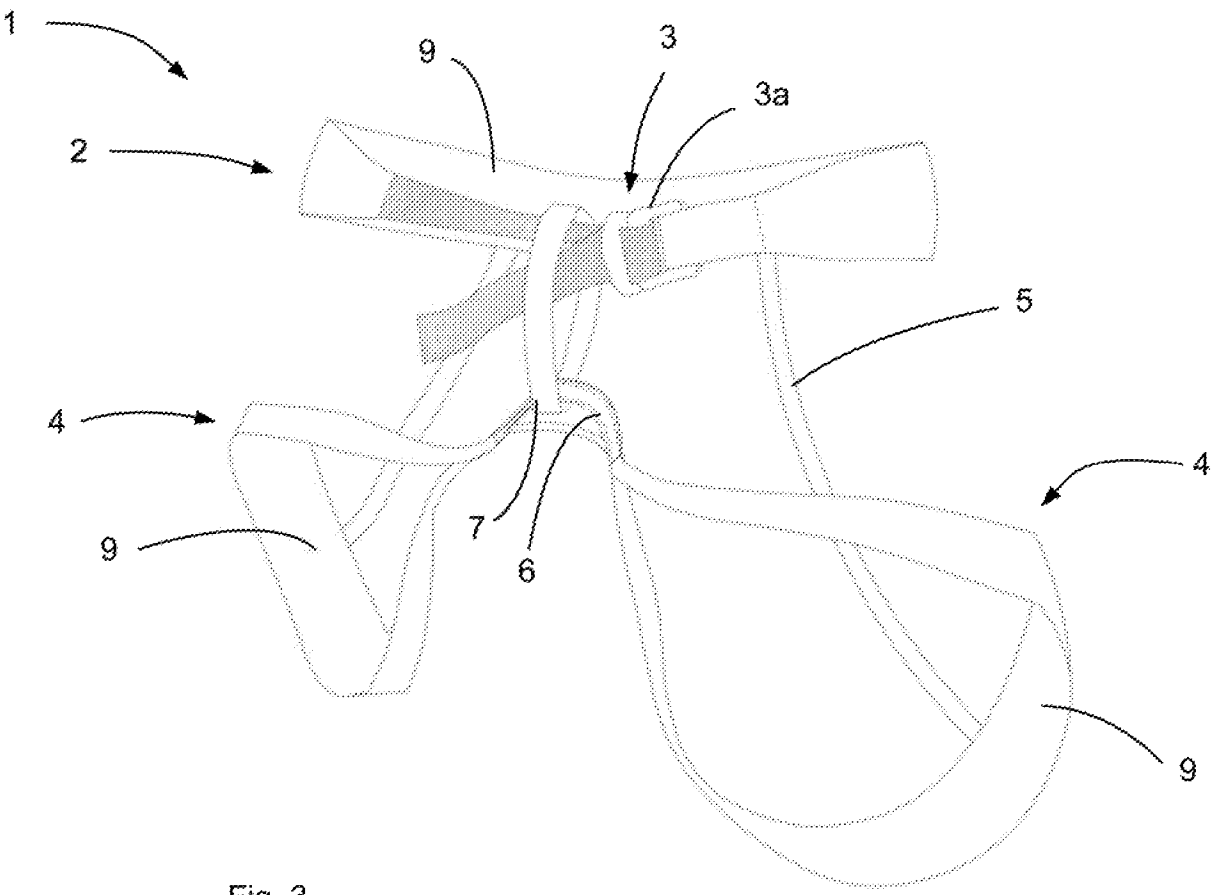

A roping harness 1 such as those represented schematically in FIGS. 1 to 3 comprises a belt 2 associated with an adjustment device 3 of the roping harness 1. The harness comprises for example a loop 3*a* fixed to one of the ends of the belt 2 in the direction of its longitudinal axis, the loop 3*a* enabling the circumference of the belt 2 to be adjusted to the waist size of the user advantageously in conjunction with the other end of the belt 2. As a variant, the harness may not be provided with the adjustment device. In a particular embodiment, the harness comprises or can be associated with a chest strap or with a pair of chest straps (not shown).

The harness 1 is also provided with a pair of thigh straps 4, each thigh strap 4 being able to be adjusted to the corpulence of the user as in the embodiments of FIGS. 1 and 2. To adjust the circumference of the thigh straps, a second adjustment device 3 comprising securing clips 3*b* can be used. These embodiments are well suited for use in mountaineering. A harness 1 such as the one represented in FIG. 3, where the thigh straps are not adjustable is on the other hand quite suitable for use in rock climbing.

Whatever the embodiment of the harness, each thigh strap 4 is advantageously joined to the dorsal part of the belt 2 by two flexible straps 5, and to the ventral part by a hasp 6 via a central ring 7.

In the specific embodiment presented in FIG. 1, each thigh strap 4 is also connected to the ventral part of the belt by means of connecting straps 8.

Figures 4A, 4B:
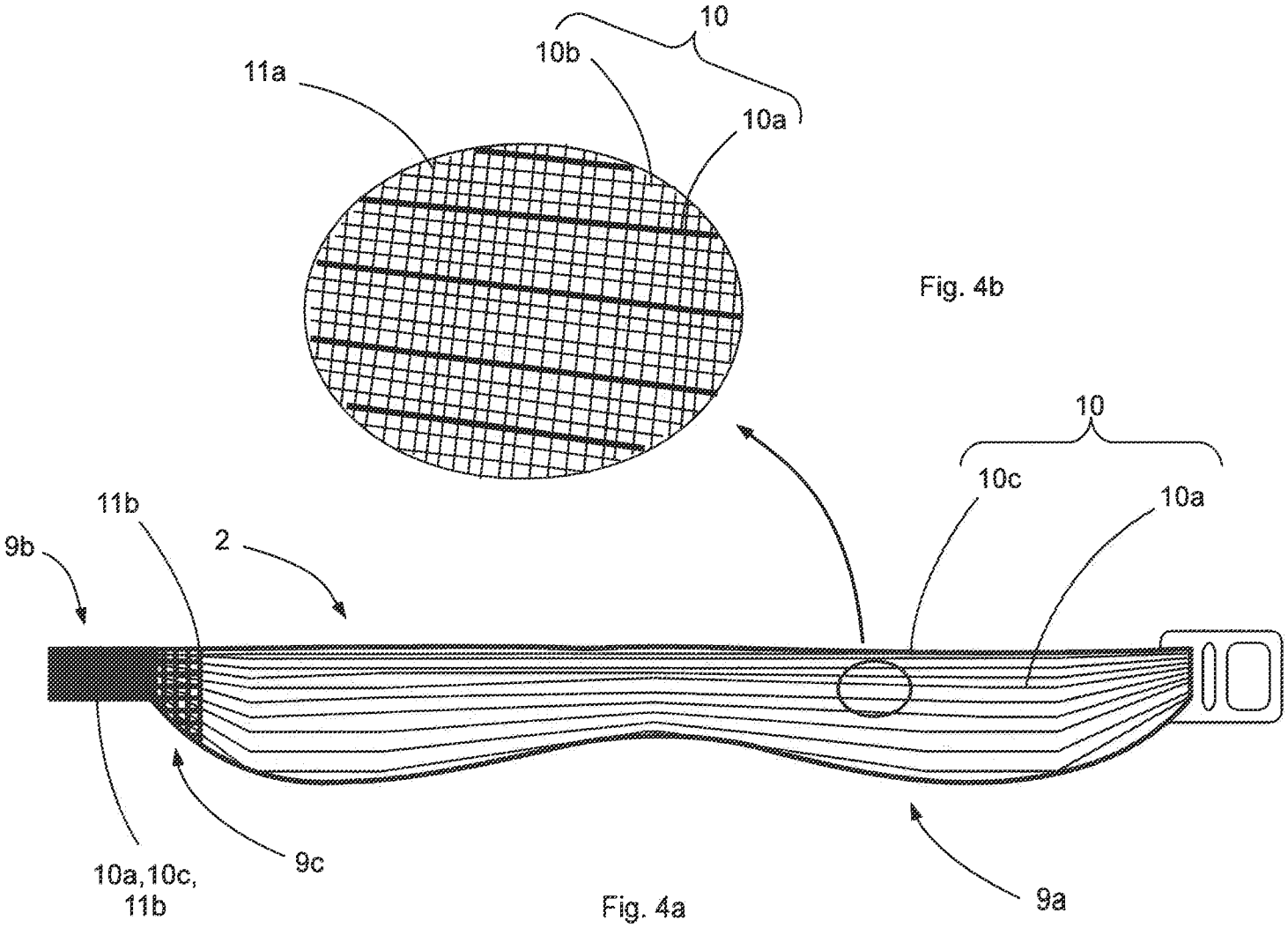
FIGS. 4*a* and 4*b* represent a belt of a roping harness according to an embodiment of the invention in schematic manner.

As presented in FIG. 4*a*, the belt 2 can be made from a strap 9 comprising at least a first area 9*a* and a second area 9*b* consecutive along the longitudinal axis of the strap 9. The strap 9 can also be used for forming a thigh strap 4 or advantageously a pair of thigh straps 4 or a chest strap or a pair of chest straps.

The first area 9*a* of the strap 9 is designed to support the user in case of dynamic use of the roping harness. In the present case, the first area 9*a* corresponds to the part of the belt 2 surrounding the user with contact, the shape of which can be adjusted to improve the comfort of the roping harness 1. The first area 9*a* is wider than the second area 9*b* so as to enhance user comfort.

As represented in FIG. 4*a*, the first area 9*a* can comprise two wider portions which snugly follow the iliac crests so that, in case of dynamic use, these sensitive parts of the body are well protected.

The second area 9*b* presents a reduced width so as to limit the volume of the harness. The adjustment device 3 is fixed to the second area 9*b* which presents specific mechanic performances. The second area 9*b* is a more flexible area than the first area which enables it to be more easily adjusted to the user's morphology and/or to collaborate more easily with an adjustment device. The rigidity of the first area 9*a* enables a good comfort to be ensured when the belt is used ensuring that the latter will not twist during use. The rigidity of the first area 9*a* will ensure a good distribution of the stresses between the user and the belt.

In an advantageous embodiment, a second area 9*b* of the belt 2 can be configured to collaborate with the adjustment device 3 to adjust the circumference of the belt 2 to the user's waist size. For example, the second area 9*b* forms a piece of strap which is slipped into a loop 3*a* to adjust the size of the belt 2. The same can be the case for the thigh straps 4 or at least one of the thigh straps 4.

The strap 9 is made from several warp threads 10 having different mechanical characteristics and at least one weft thread 11*a*, 11*b*.

Preferably, several different warp threads are used to form the strap 9. The different warp threads present different mechanical characteristics. These different characteristics can be obtained by using different materials and/or by using different thread diameters.

In an advantageous embodiment, at least three different types of warp threads 10 are used to form the strap 9. The three types of warp threads can be made from three different materials. As a variant, the strap 9 comprises two different types of warp threads or four different types of warp threads.

The strap more precisely comprises at least a first area 9*a* and a second area 9*b* which have different mechanical characteristics. The differences of mechanical characteristics between areas 9*a* and 9*b* originate from the use of different groups of warp threads. The differences of mechanical characteristics can be observed along the longitudinal axis of the strap or along a transverse axis or again in torsion or flexion.

The differentiation of the mechanical characteristics between the areas 9*a* and 9*b* originates from the removal of certain warp threads with respect to all the warp threads used in the strap 9. Elimination of part of the warp threads of the strap 9 in area 9*a* and of another part of the threads in area 9*b* enables these two areas of the strap 9 to be specialised for their mechanical characteristics. The warp threads of the strap 9 are grouped in at least three groups of warp threads 10*a*, 10*b*, 10*c* and in several areas of the strap 9, at least one of the groups of warp threads being missing.

However, a first group of warp threads 10*a* runs through the first area 9*a* and second area 9*b* so as to ensure a good transmission of the forces during dynamic use of the harness while remaining compact. Keeping the first group of warp threads 10*a* in areas 9*a* and 9*b* avoids the necessity of a stitching step which makes the harness heavier and less flexible in the areas of additional thickness.

Advantageously, the first group of warp threads 10*a* runs through the whole of the roping harness 1. The first group of warp threads 10*a* ensures retransmission of the forces along the strap 9, for example between the two fixing points after securing device 3 or from the fixing point of the securing device to the portion of strap collaborating with the device 3 for adjusting the size of the strap.

The first area 9*a* of the strap 9 is formed by the first group of warp threads 10*a* and a second group of warp threads 10*b*. The first area 9*a* is not provided with a third group of warp threads 10*c*.

The second area 9*b* of the strap 9 is formed by the first group of warp threads 10*a* and the third group of warp threads 10*c*. The second area 9*b* is not provided with the second group of warp threads 10*b*.

According to one embodiment, the first group of warp threads 10*a* and the second group of warp threads 10*b* can be distributed over the width of the strap 9 in the first area 9*a*. This means that the threads of the first group of warp threads 10*a* can be joined to the threads of the second group of warp threads 10*b* along the width of the belt in the first zone 9*a*, so that the threads of the first group of warp threads 10*a* are placed in the neighborhood of the threads of the second group of warp chain 10*b* and vice versa.

According to an advantageous embodiment, the first group of warp threads 10*a* and the second group of warp threads 10*b* are uniformly distributed in the orthogonal direction to the longitudinal axis of the strap 9 in the first area 9*a*.

The first, second and third groups of warp threads do not have any warp threads in common.

For example purposes, the first group of warp threads 10*a* is formed by several warp threads having different mechanical characteristics. The first group of warp threads 10*a* can be formed by a first series of first warp threads and by a first series of second warp threads.

The second group of warp threads 10*b* is formed by several warp threads having different mechanical characteristics, for example, a second series of first warp threads and by a second series of second warp threads. The third group of warp threads 10*c* is formed by several warp threads having different mechanical characteristics, for example, a third series of first warp threads and by a series of third warp threads.

It is also possible to provide for each of the first, second and third groups of warp threads 10*a*, 10*b*, 10*c* to be formed by series of first, second and third warp threads.

However, as the different warp threads have different mechanical performances, it is advantageous to select their number and their position in the harness 1 in order to limit the total number of warp threads and therefore the volume and weight of the strap 9. To form a compact and light strap, it is advantageous to form groups of warp threads in which at least 50% of the threads of the group are identical. For example, the first group of warp threads 10*a* is mainly formed by the first warp thread. The second group of warp threads 10*b* can be mainly formed by the second warp thread. The third group of warp threads 10*c* can be mainly formed by the third warp thread.

In an advantageous embodiment, the groups of warp threads comprise at least 75% of identical threads or even 85% of identical threads. The larger the quantity of identical threads in a group, the more it is possible to gain weight by selecting the most suitable warp threads for the area involved 9*a* or 9*b*.

In a particularly advantageous embodiment, the second group of threads 10*b* is formed solely by the second warp threads and the third group of threads 10*c* is formed solely by the third warp threads.

The first group of threads 10*a* can be formed solely by the first group of threads to gain in compactness, but it appears advantageous to keep some second and/or third warp threads and to place them on the edges of the strap 9 to improve the strength of the edges of the strap thereby preserving a pleasant aspect for the user.

The materials used to form the warp threads 10 and weft threads 11*a*, 11*b* are judiciously chosen in order to obtain a light, flexible, compact and dependable roping harness.

The first warp threads 10*a* are designed to be present in the areas 9*a* and 9*b* and preferentially from one end of the strap 9 to the other. They are advantageously mechanically stronger than the other warp threads. In the first area 9*a*, there are a large number of second warp threads to increase the contact surface with the user whereas in the second area 9*b* smaller dimensions are sought for. It is therefore preferable to have second warp threads that are mechanically less strong than the third warp threads.

In order to ensure a good transmission of the forces, the first warp threads 10*a* running through the whole of the strap 9 can be made from polyamide or from polyethylene with ultra high molecular weight, which is marketed in particular under the tradename Dyneema® or Spectra®. What is meant by ultra high molecular weight is that the polyethylene used has at least 100,000 monomers per molecule, and preferentially has a molar mass approximately equal to $3\times10^6$ g/mol. As an alternative, the first weft threads 11*a* can be made from poly(p-phenylene terephtalamide (PPD-T) marketed for example under the brand names Kevlar® or Twaron®, from para-aramid copolymers marketed for example under the brand name Technora®, or aromatic polyesters such as the one marketed under the brand name Vectran®.

These materials present a Young's modulus of more than 130 GPa, which means that the first warp threads are very rigid. Their elongation at rupture is less than 10%, preferentially 5%.

The second warp threads 10*b* and the first weft thread 11*a*, used for weaving the first area 9*a* of the strap 9, can advantageously be made from a material having a base formed by polyester, polyamide, or polypropylene, the linear density of which is comprised between 300 dTex and 1760 dTex.

These materials are less solid than those used to form the first warp threads 10*a*. What is meant by less solid is that the loop resistance of the second warp threads and of the first weft thread 11*a* is lower than that of the first warp threads 10*a*. This means that when a loop is formed with a first warp thread 10*a* and a loop is formed with a second warp thread 10*b* or with a first weft thread 11*a*, and a traction force is exerted on the interwoven loops, the second warp thread 10*b* or the first weft thread 11*a* breaks first.

The second warp threads 10*b* and the first weft thread 11*a* do however present the advantage of being about ten times lighter than the first warp threads 10*a*. Their use is therefore enables the weight of the roping harness 1 to be reduced.

The second warp threads 10*b* and first weft thread 11*a* can advantageously be monofilaments. What is meant by monofilaments is that the threads can be obtained for example by coagulation of a continuous flow of liquid, by extrusion with drawing, or by spinning with cold drawing. A single thread of synthetic material is thus obtained the diameter of which is preferentially comprised between 0.1 and 0.4 mm. According to an embodiment that is well suited for manufacturing the strap, the diameter of the monofilaments can be equal to 0.24 mm.

The use of monofilament makes it possible to easily produce a first area 9*a* that is rigid and in particular that presents a good lateral rigidity.

The cross-section of the second warp threads 10*b* and of the first weft thread 11*a* can be smaller than that of the first warp threads 10*a*. This enables the thickness of the first area 9*a* of the strap to be limited and improves its compactness. The thinness of these threads gives the first area 9*a* a ventilated and breathing effect. User comfort during his sporting activity is thus improved compared with the use of a roping harness of the prior art.

The third warp threads 10*c* and possibly the second weft thread 11*b* are for their part advantageously made from polyamide or from polyester or high tenacity polypropylene, i.e. having at least 100,000 monomers per molecule. Unlike the second warp threads 10*b* and the first weft thread 11*a*, the third warp threads 10*c* and the second weft thread 11*b* are advantageously multi-filaments. This characteristic and the high tenacity of these threads give the second area 9*b* of the strap 9 an enhanced resistance compared with the first area 9*a*. The use of such warp threads makes it possible to form a second area 9*b* that this flexible and that allows stitching operations. The second area 9*b* is a privileged area for performing assembly of the strap with other components. On the contrary, the first area 9*a* made from monofilaments is not practical for the purposes of stitching.

The choice of these materials also ensures satisfactory operation of the assembly composed of the strap 9 and loop 3*a*. The sliding properties on the one hand enable good sliding of the area 9*b* when clamping is performed in the loop 3*a*, and on the other hand efficient locking of the strap 9 clamped in the loop 3*a* when a tension is applied.

Furthermore, the materials of the third warp threads 10*c* and of the second weft thread 11*b* are chosen so as to optimise operation of the second area 9*b* with the adjustment device 3 and in particular with the loop 3*a*. To improve comfort, it is advantageous to cover the first warp threads 10*a* with the third warp threads 10*c* so as to keep the first warp threads 10*a* in the heart of the second area 9*b* of the strap 9. The material of the first warp threads 10*a* is in fact particularly strong but has a low friction coefficient, which could lead to sliding of the second area 9*b* inside the adjustment device 3. Consequently, this can lead to a maladjustment of the roping harness 1. By placing the third warp threads 10*c* as an additional thickness with respect to the first warp threads 10*a*, the sliding properties of the strap 9 in the loop 3*a* are optimal.

These embodiments are usable to form a harness belt by means of the different embodiments of the strap set out in the foregoing.

The first warp threads 10*a* can be regularly distributed in the strap 9 in an orthogonal direction to the longitudinal axis of the strap 9 so as to guarantee a uniform strength in the whole of the strap 9. The same can be the case for the second and/or third warp threads 10*b* and/or 10*c*. In order to have the best transmission of forces in the strap 9, it is advantageous to have a uniform distribution of the different warp threads present.

In the first area 9*a* of the strap 9, the second warp threads 10*b* can preferably be placed between the first warp threads 10*a* so that the first and second warp threads 10*a* and 10*b* are uniformly distributed in the orthogonal direction to the longitudinal axis of the strap 9. The arrangement of the first, second and third warp threads 10*a*, 10*b*, 10*c* in the first area 9*a* can be formed in repetitive manner in the orthogonal direction to the longitudinal axis of the strap 9.

According to an exemplary embodiment, at least three second warp threads 10*b* can be placed between two consecutive first warp threads 10*a*. In similar manner, the first and third warp threads 10*a* and 10*c* can be arranged in uniform manner in the second area 9*b* of the strap 9 in the orthogonal direction to the longitudinal axis of the strap 9.

Furthermore, the number of third warp threads 10*c* placed between two consecutive first warp threads 10*a* to form the second area 9*b* of the strap 9 can be different from the number of second warp threads 10*b* placed between the first warp threads 10*a* to form the first area 9*a*. The third warp threads 10*c* can also be positioned as an additional thickness on each side of the first warp threads 10*a* to obtain a second area 9*b* that is less broad than the first area 9*a*. The third area 9*c* of the strap 9 then has a substantially trapezoid shape.

In the remainder of the description, for ease of reading, the first group of warp threads 10*a* is considered as being formed solely by the first warp threads. The same is the case for the second and third groups of warp threads 10*b*, 10*c* which are considered as being formed solely by the second or third warp threads. The person skilled in the art will keep in mind the fact that the notions of first, second and third warp threads refer more generally to first, second and third groups of warp threads.

The first area 9*a* can comprise first and second warp threads 10*a* and 10*b* and weft thread or one of the weft threads 11*a*, 11*b* for the first area 9*a* to form a strap. The second area 9*b* can comprise first and third warp threads 10*a* and 10*c* and the weft thread or one of the weft threads 11*a*, 11*b* for the second area 9*b* to form a strap.

The strap 9 is therefore formed by two unitary straps in the first and second areas 9*a* and 9*b*. The area 9*a* is not stitched onto the area 9*b*.

The strap 9 is devoid of the second warp threads 10*b* in the second area 9*b*, and of the third warp threads 10*c* in the first area 9*a*. The first and second areas 9*a* and 9*b* are not formed by the same warp threads which enables differentiation of their mechanical performances.

The strap 9 can comprise a third area 9*c* in which the first, second and third warp threads 10*a*, 10*b* and 10*c* are to be found at the same time. The third area 9*c* advantageously corresponds to an area forming the junction between the first and second areas 9*a* and 9*b*. The third area 9*c* can be of any shape but it is advantageously trapezoid to ensure a good transfer of the forces.

In an advantageous embodiment, the second threads 10*b* which are not used in the first area 9*a* are cut in order to avoid an unnecessary extra weight. This embodiment enables the strap 9 to be functionalised and the useless warp threads to be eliminated to gain in compactness, weight and/or flexibility depending on the type of warp thread eliminated.

The third area 9*c* corresponds to a connection area between the first and second areas 9*a* and 9*b*, and can comprise a stitching forming an additional thickness (not shown) designed to ensure the solidity of the strap 9.

As an alternative, the third area 9*c* can correspond to an area in which the first, second and third warp threads 10*a*, 10*b*, 10*c* are woven in association with the weft thread 11*a*, 11*b* so as to guarantee a dependable connection between the first and second areas 9*a* and 9*b*.

It is in fact advantageous for the first area 9*a* to be wider than the second area 9*b*, as the first area 9*a* is designed to be in contact with the user when the latter has a fall for example. The wider the first area 9*a*, the more comfortable the roping harness 1, as the forces exerted by the roping harness 1 on the user are better distributed. However, to have a very broad first area 9*a*, it is necessary to have a large number of voluminous warp threads 10 and/or warp threads 10.

The second area 9*b* can furthermore be less broad than the first area 9*a* in a direction orthogonal to the longitudinal axis of the strap 9*b*, as this second area 9*b* is not designed to be in contact with the user. Reducing the width of this second area 9*b* then enables the compactness of the roping harness 1 to be improved.

As indicated previously, the strap 9 is furthermore manufactured by means of at least one weft thread 11*a*, 11*b* being able for example to be made from an identical material to that of one of the warp threads 10 used. The weft thread 11*a*, 11*b* can advantageously run through the whole of the first and second areas 9*a* and 9*b* to ensure the solidity of the device.

However, according to an alternative embodiment represented in FIG. 4*a*, the belt 2 can also be made using two different types of weft threads 11*a*, 11*b*. A first weft thread

11*a* is used for weaving the first area 9*a*. This first weft thread 11*a* is made from a material that is advantageously identical to that of the second warp threads 10*b*. And a second weft thread 11*b* is used for weaving the second area 9*b*, the second weft thread 11*b* having advantageously identical mechanical properties to those of the third warp threads 10*c*.

Thus, according to the specific embodiment that is illustrated in the figures, the first weft thread 11*a* used for weaving of the first area 9*a* can be cut and replaced by the second weft thread 11*b* in order to weave the strap 9. It is preferable to weave the first and second areas 9*a* and 9*b* with a single weft thread to avoid making the roping harness 1 heavier. The first area 9*a* and/or second area 9*b* can however be manufactured by simultaneously weaving the first and second weft threads 11*a* and 11*b* so that at least one of the weft threads runs through the whole of the strap 9.

It is also possible to secure the second weft thread 11*b* on the edge of the first area 9*a* and to secure the first weft thread 11*a* on the edge of the second area 9*b*. This embodiment of simpler design can be advantageous in so far as it does not result in a too large extra weight of the roping harness 1. The two weft threads are present from one end of the strap 9 to the other, which makes the manufacturing process easier.

A thigh strap 4 of a roping harness 1 can also be manufactured by means of a strap 9 such as the one that has just been described in relation with a belt 2 of a roping harness 1.

To form a belt 2 or a thigh strap 4, it is advantageous to provide for the strap 9 to comprise a first area 9*a* acting as support strip and a second area 9*b* at each of the ends of the first area 9*a*. As an alternative, one of the two areas 9*b* is replaced by an area 9*c*, but this embodiment is heavier.

This embodiment is particularly advantageous as a single strap 9 forms a thigh strap 4 with a broad area 9*a* providing user comfort and two stronger areas 9*b* for the strength of the product. The use of a single strap 9 with two different areas enables a gain in compactness and weight in comparison with a single strap which is wider. The use of a single strap with two different areas enables a gain in compactness and weight in comparison with more complex structures where the strap which we transmits the forces is narrow and is stitched to a wider area to limit the discomfort of the narrow strap. The use of a single strap 9 with two different areas further avoids having to perform stitchings between the different portions of the thigh strap 4.

In an embodiment illustrated in FIG. 1, the connecting strap 8 connecting the belt 2 with one of the thigh straps is formed by a second area 9*b*. As a variant, a third area 9*c* can be used, but this solution is heavier. The hasp 6 can also be formed by a second area 9*b*. The connecting strap 8 is advantageously sewn onto the belt. According to the embodiments, the strap 9 is used to form a thigh strap 4 and a connecting strap 8 and/or a thigh strap and a hasp 6.

In a particularly advantageous embodiment, the two thigh straps 4 are formed with one and the same strap 9. This configuration enables a better transmission of the forces by means of the hasp 6 while remaining more compact in comparison with a solution where the connection of the two thigh straps is made by fixing the two straps of the thigh straps at the level of the hasp for example by stitching. In addition to the two thigh straps, the strap 9 can also form the two connecting straps 8.

In the embodiment illustrated in FIGS. 1 to 3, there are three second areas 9*b* and two first areas 9*a*. Two consecutive second areas 9*b* are separated by a first area 9*a*. Two consecutive first areas 9*a* are separated by a second area 9*b*. In a particular case, the first and second areas 9*a* and 9*b* are placed alternately along the longitudinal axis of the strap 9. In this embodiment, the first areas 9*a* act as support strips of the thigh strap 4.

As previously, it is advantageous to place a third area 9*c* between a first area 9*a* and a second area 9*b*.

It is further possible to replace a second area 9*b* by a third area 9*c* but the strap is heavier.

To form an adjustable thigh strap 4 as illustrated in FIGS. 1 and 2, it is possible to fix an adjustment part 3 such as a loop on one of the second areas 9*b*. Other second area 9*b* defines the thigh strap 4. In this configuration, one of the areas 9*b* is used to form the connecting strap 8 (particular case of an embodiment represented in FIG. 1) or the hasp 6, and the other area 9*b* recloses the thigh strap by collaborating with the adjustment part 3.

As a variant represented in FIG. 1, the adjustment part 3 can be fixed onto the two second areas 9*b* to close the thigh strap 4. The two second areas 9*b* of the thigh strap can then form the hasp 6 and the connecting strap 8. A more precise alternative embodiment can consist in stitching the adjustment part which for example comprises a clip 3*b*.

In this type of configuration, the use of a connecting strap 8 is particularly advantageous in a harness 1 where the thigh strap 4 can open so as to facilitate fitting of the harness on the user. There are many conditions in which the user does not have the possibility of passing his foot through the thigh strap 4. It is then particularly advantageous to be able to open and close the thigh strap 4. The connecting strap 8 enables the shape of the harness to be kept when the thigh strap 4 is open.

The strap 9 also enables a harness with a non-adjustable thigh strap 4 to be formed in compact manner and reducing the stitching steps, as illustrated in FIG. 3.

As a variant that is not represented, a first of the second areas 9*b* can act as connecting strap 8 with the belt 2 or as a hasp 6 whereas the other second area 9*b* is fixed onto the first second area 9*b* to reclose the thigh strap. In case of fixing by stitching, the thigh strap is not adjustable by means of an adjustment system for example a loop system represented in FIG. 1 to adjust the belt 2.

Figure 5:
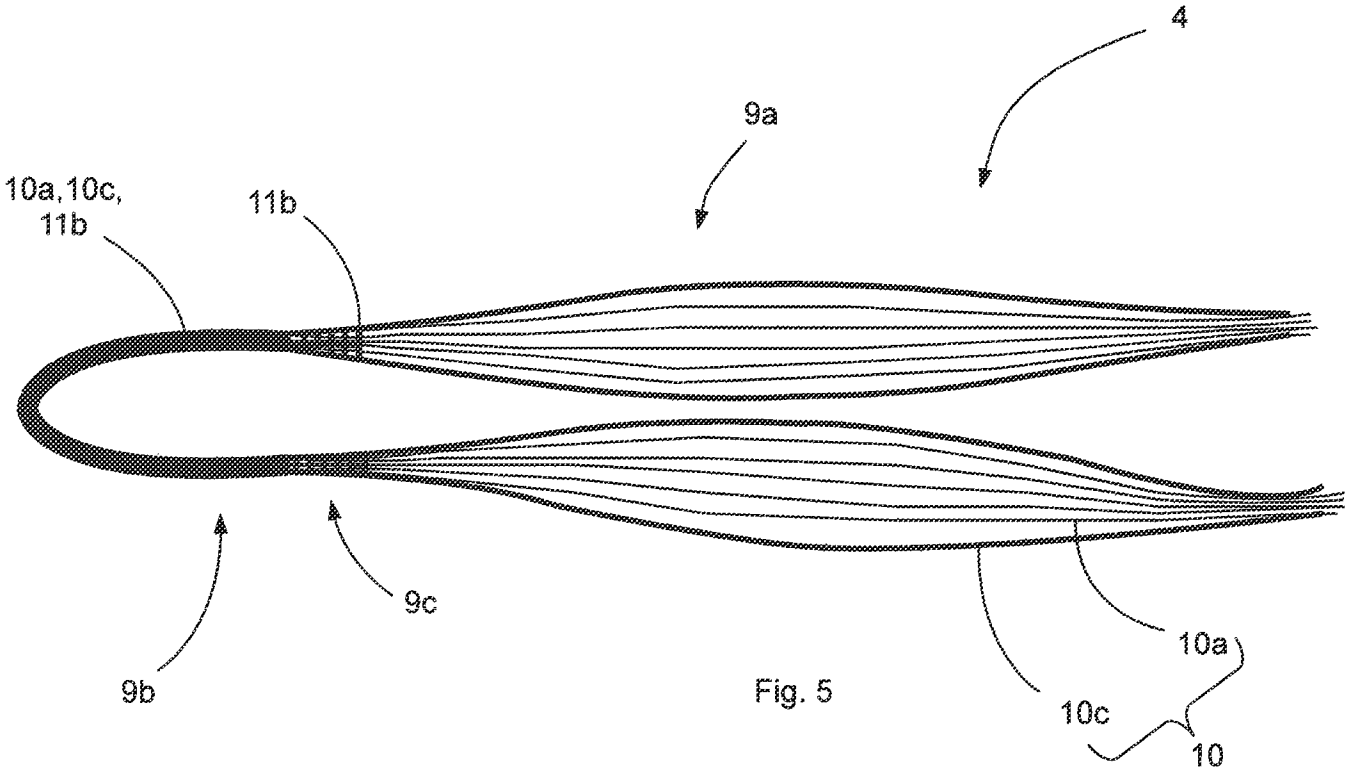
FIG. 5 illustrates another embodiment of a pair of thigh straps of a roping harness in schematic manner.
Figures 6A, 6B:
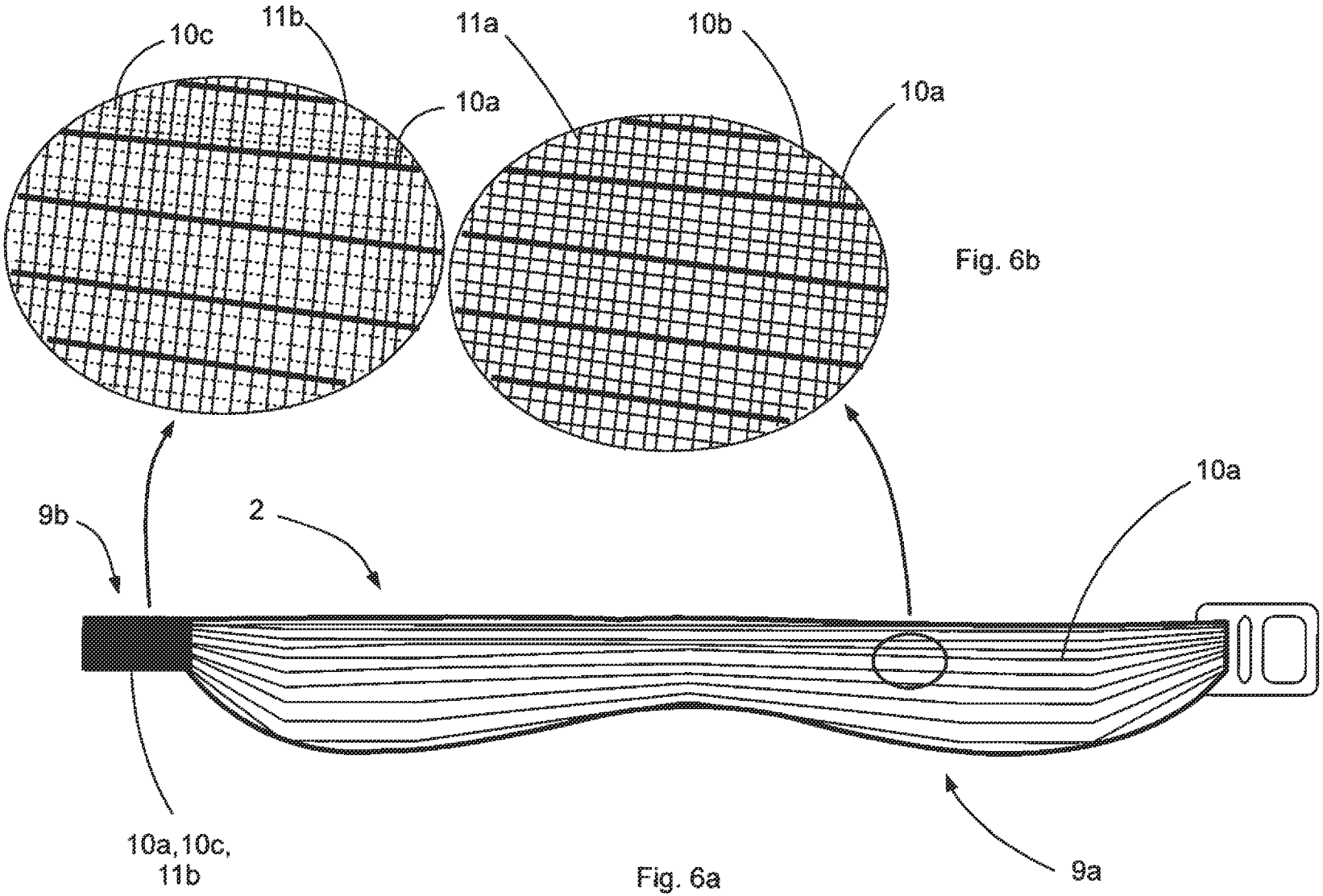
FIGS. 6*a* and 6*b* represent a belt of a roping harness according to another embodiment of the invention in schematic manner.

In the case of a non-adjustable thigh strap, the connecting strap 8 can be eliminated. As an alternative, the hasp 6 can be formed by stitching of two straps 9 each forming a thigh strap 4. Two areas 9*b* or 9*c* are stitched to one another. The strap 9 can also form the two thigh straps and the hasp 6 as is represented in the embodiment illustrated in FIG. 5.

As a variant, the two second areas 9*b* can be stitched to one another so as to close the thigh strap 4. The hasp 6 and/or connecting strap 8 can be formed by an additional strap if necessary. This embodiment is less advantageous as it requires formation of a hasp 6 which will take up the stresses, and therefore additional stitching steps. In this embodiment, the thigh strap is non-adjustable.

The foregoing embodiments describe manufacturing of first and second areas 9*a* and 9*b* with specific groups of warp threads and a third area 9*c* which contains all the warp threads. It is further possible to provide additional areas where a part of the warp threads of the second group of warp threads 10*b* are associated with a part of the third group of warp threads 10*c* to form a fourth group of warp threads.

In the foregoing embodiments, the threads not used in areas 9*a* and/or 9*b* can be eliminated. Ends of the threads forming the second group of warp threads 10*b* are then located at one of the edges of the second area 9*b* and/or ends of the threads forming the third group of warp threads 10*c* are located at one of the edges of the first area 9*a*. What is meant by edge is the junction between two consecutive areas of the strap, i.e. a junction defined in a transverse direction to the longitudinal axis of the strap.

In an alternative embodiment, the warp threads that are not used in the first area 9*a* and/or in the second area 9*b* are kept and woven with another weft thread to form another strap. In these new embodiments, the strap 9 can be split into two. What is meant by split into two is that the strap 9 is a single strap in an initial area and is then split into two straps afterwards. Each portion of the split strap comprises one or more warp threads woven with a weft thread. This embodiment avoids having to stitch a first strap onto a second strap so that they share a part of the forces undergone.

The split straps are mechanically independent except at the starting point. The two straps 9 originating from the split share warp threads with the single portion. Each of the split straps comprises at least warp threads and at least one weft thread.

Depending on the embodiments, the first areas 9*a* and/or second areas 9*b* can be split into two. The split can be initiated for example in third areas 9*c* forming the junction between the first area 9*a* and second area 9*b*. There is then an additional strap woven by means of the third group of warp threads 10*c* and which starts at one of the edges of the first area 9*a* and/or an additional strap woven by means of the second group of warp threads 10*b* and which starts at one of the edges of the second area 9*b*. The split then forms the first area 9*a* or second area 9*b* and an additional strap.

In a first particular embodiment, the split is used for the belt 3. The first area 9*a* is formed as indicated in the foregoing. The warp threads not used to form the area 9*a* or a part of these warp threads are woven to form an additional strap which is arranged to form one or more equipment holders. The additional strap is advantageously cut and fixed so as to make the equipment holders extend on each side of the harness.

As a variant, it is also possible to provide for the second area 9*b* to be formed as indicated in the foregoing. The warp threads not used to form the area 9*b* or a part of these threads are woven to form an additional strap which is arranged to fold onto the first area 9*a* and to form for example an equipment holder or another attachment part. However, this embodiment is less strong than the previous embodiment.

In another embodiment linked to the thigh straps 4, the second area 9*b* defining the hasp 6 is split so as to limit the movement of the central ring 7.

The area 9*b* defining the hasp 6 is formed as indicated in the foregoing, and the unused threads are woven to form an additional strap. The area 9*b* and the additional strap are mechanically separated outside the doubling-up areas and they define a space inside which the central ring 7 can move.

In a stronger embodiment, the additional strap limiting the movement of the central ring is formed from splitting into two of one of the areas 9*a* forming the support area of a thigh strap 4. The additional strap is cut to form two ends of strap 9. One of the ends of additional strap is folded over in the direction of the hasp 6.

As a variant, splitting of the areas 9*a* into two can be performed on the two thigh straps 4 so as to form two additional straps. The two additional straps are cut and two of the strap ends formed are folded in the direction of the hasp and fixed to one another for example by stitching. The movement of the central ring 7 is limited on one side by the hasp 6 and on the other side by the two strap ends fixed to one another.

For example purposes, the other end of additional strap can be cut or used to close the thigh strap which is then non-adjustable. It is further possible to fix an adjustment device 3 between the end of the first area 9*a* and the hasp 6 and to use the remaining end of additional strap to collaborate with the adjustment device 3 either by means of a clip or directly by working with a loop as for the belt. The embodiment with a clip is illustrated for example in FIG. 1.

In another configuration, it can further be envisaged to split the strap 9 at the level of the first area 9*a* to form an additional strap. The additional strap formed facing the area 9*a* will define and close the thigh strap 4. The areas 9*a* will form the support areas as previously whereas the additional straps will close the thigh straps 4. In this configuration, the thigh straps 4 are not adjustable. This embodiment is particularly advantageous as the thigh straps are formed exclusively by weaving.

In this embodiment, the hasp 6 can be formed by a third area 9*c* to avoid having to perform any stitching and/or cutting operation of the pair of thigh straps. This embodiment can be combined with the previous embodiment on formation of the hasp with its additional strap.

To enhance user comfort at the level of the thigh straps, other embodiments are possible. In these different embodiments, an additional strap is formed facing the first area 9*a*. This additional strap is cut so as to increase the surface of first area 9*a* which supports the user's thigh.

As previously, an additional strap is formed by splitting the strap 9 facing the first area 9*a* into two. The additional strap 9*a* is cut to form two ends of additional straps.

In a first instance, the two strap ends are fixed to one another to define the dimension of the thigh strap. In another instance, an adjustment device 3 is fixed to one of the strap ends, for example a loop. The other strap end collaborates with the loop to form an adjustment device of the thigh strap 4. In yet another embodiment, a part of the adjustment device 3 is fixed onto each of the ends of additional strap, for example clips.

What is done for one thigh strap can be done for the other thigh strap. These embodiments are particularly advantageous as they are compact and avoid stitching operations. The different components of the thigh strap are formed when weaving of the strap is performed which avoids stitching operations. Depending on the embodiments, it is possible to provide adjustable or non-adjustable thigh straps.

It is also advantageous for the strap 9 to have at least two identical weft threads 11*a*, 11*b* to facilitate starting of the split areas. The loom used to weave the strap 9 has to have a double-loom function and be able to form two superposed straps from a single strap. For this, the loom has to be configured to separate the warp threads into two distinct packets and to associate a weft thread with each packet so as to form the two portions of the second area 9*b*.

In the latter embodiments, an additional strap is woven by means of the second group of warp threads 10*b* or a part of the second group of warp threads 10*b* and it starts at one of the edges of the second area 9*b* to form an equipment holder and/or to collaborate with an adjustment device 3.

In other embodiments, an additional strap can be woven by means of the third group of warp threads 10*c* or a part of the third group of warp threads 10*c*, and start at one of the edges of the first area 9*a* to form an equipment holder and/or to collaborate with an adjustment device 3. These two embodiments can be combined.

It is also possible to provide a strap where certain threads are cut in certain parts and where additional straps are formed by splitting in other parts.

The strap represented in FIG. 1 illustrates an embodiment of a harness. However, the strap can have other uses, for example harness chest straps, rucksack shoulder straps or a fixing strip for a headlamp. In all these embodiments, it is possible to take advantage of the first and second areas without having their drawbacks. The different materials used enable the mechanical performances of the strap to be made to vary, but they also enable the dimensions of the strap and/or its surface or torsion characteristics to be modified. As a variant, the different materials used first of all enable the dimensions of the strap and/or its surface or torsion characteristics to be modified without varying the mechanical performances of the strap. In this second case, the effect of the warp threads of the second and third groups on the mechanical performances of the strap is negligible.

The invention claimed is:

1. A strap comprising:

a first longitudinal end and a second longitudinal end opposite to the first longitudinal end along a longitudinal axis of the strap;

a first transversal end and a second transversal end opposite to the first transversal end along a transversal direction orthogonal to the longitudinal axis;

at least one weft thread;

a plurality of different warp threads having different mechanical characteristics, the plurality of different warp threads extending along the longitudinal axis, the plurality of different warp threads comprising:

a first group of warp threads extending continuously from the first longitudinal end to the second longitudinal end, a second group of warp threads different from the first group of warp threads, the second group of warp threads being cut between the first longitudinal end and the second longitudinal end, and a third group of warp threads different from the first and second groups of warp threads, the third group of warp threads not continuously extending from the first longitudinal end to the second longitudinal end;

a first woven area formed of the first group of warp threads and the second group of warp threads woven with the at least one weft thread, the first woven area being devoid of the third group of warp threads, the first area extending from the first transversal end to the second transversal end, wherein in the transversal direction, at least one warp thread of the second group of warp threads separates two consecutive warp threads of the first group of warp threads and at least one warp thread of the first group of warp threads separates two consecutive warp threads of the second group of warp threads; and a second woven area formed of the first group of warp threads and the third group of warp threads woven with the at least one weft thread, the second woven area being devoid of the second group of warp threads, the second woven area extending from the first transversal end to the second transversal end, wherein in the transversal direction, at least one warp thread of the third group of warp threads separates two consecutive warp threads of the first group of warp threads and at least one warp thread of the first group of warp threads separates two consecutive warp threads of the third group of warp threads, wherein the first woven area and the second woven area are adjacent along the longitudinal axis of the strap, the second woven area having different mechanical characteristics than the first woven area, and wherein the first group of warp threads, the second group of warp threads and the third group of warp threads have no warp thread in common.

2. The strap according to claim 1, wherein the first group of warp threads and the second group of warp threads are both uniformly distributed in the transversal direction in the first woven area, the first group of warp threads comprising first warp threads and the second group of warp threads comprising second warp threads, two consecutive first warp threads being separated by second warp threads along the transversal direction.

3. The strap according to claim 1, comprising at least a third woven area formed of the first group of warp threads, the second group of warp threads and the third group of warp threads woven with the at least one weft thread, the third woven area separating the first woven area and the second woven area along the longitudinal axis of the strap, the third woven area having different mechanical characteristics than the second area and the first area.

4. The strap according to claim 1, wherein the first woven area is wider than the second woven area along the transversal direction.

5. The strap according to claim 1, wherein the first group of warp threads comprises first warp threads regularly distributed along the transversal direction from the first transversal end to the second transversal end and the second group of warp threads comprises second warp threads regularly distributed along the transversal direction from the first transversal end to the second transversal end, the second warp threads having different mechanical properties than the first warp threads and two consecutive first warp threads being separated by second warp threads along the transversal direction.

6. The strap according to claim 1, wherein:

the first group of warp threads mainly comprises first warp threads made from a first material, the second group of warp threads mainly comprises second warp threads made from a second material different from the first material, and the third group of warp threads mainly comprises third warp threads made from a third material different from the first material and from the second material.

7. The strap according to claim 6, wherein the first group of warp threads has first warp threads having a low friction coefficient and wherein the third group of warp threads is arranged to provide an additional thickness with respect to the first warp threads in the second woven area, the second area cooperating with an adjustment device configured to adjust a length of the strap.

8. The strap according to claim 7, wherein the second area is configured to collaborate with a loop of the adjustment device.

9. The strap according to claim 1, wherein the first woven area is formed of the first group of warp threads and the second group of warp threads mainly woven with a first weft thread, and wherein the second woven area is formed of the first group of warp threads and the group of warp threads mainly woven with a second weft thread.

10. The strap according to claim 9, wherein the first weft thread is a monofilament made from a material having a base formed by polyester, polyamide, or polypropylene.

11. The strap according to claim 10, wherein the second weft thread is made from polyamide or from polyester having at least 100,000 monomers per molecule.

12. A roping harness comprising a belt, a pair of thigh straps and a first strap formed from the strap according to claim 1, the first strap forming the belt.

13. The roping harness according to claim 12, further comprising at least an adjustment device configured to adjust a length of the first strap, the adjustment device being fixed to two of the second woven area, the two second woven areas being separated by the first woven area, the two second woven areas and the first woven area being aligned along the longitudinal axis of the first strap.

14. The roping harness according to claim 13, further comprising:

a second strap that is a first thigh strap of the pair of thigh straps formed by the strap, and the second strap is terminated by a second woven area, the second woven area of the second strap being sewn onto a second woven area of the first strap.

15. The strap according to claim 1, wherein the first group of warp threads is mechanically stronger than the second group of warp threads and the third group of warp threads.

16. The strap according to claim 1, wherein the first group of warp threads comprises first warp threads made from a material having a Young's modulus of more than 130 GPa and the second group of warp threads is mainly constituted by second warp threads ten times lighter than the first warp threads.

17. The strap according to claim 1, comprising an additional second woven area made by the first group of warp threads and the third group of warp threads woven with the at least one weft thread, the additional second woven area being devoid of the second group of warp threads, the first woven area separating the second woven area and the additional second woven area.

18. The strap according to claim 1, wherein the warp threads of the second group of warp threads and the warp threads of the third group of warp threads have a terminal end located at one interface between the second woven area and the first woven area.

19. A roping harness comprising a belt, a pair of thigh straps and a first strap formed from the strap according to claim 1, the first strap forming a first thigh strap of the pair of thigh straps.

20. A roping harness comprising a belt, a pair of thigh straps and a first strap formed from the strap according to claim 1, the first strap forming the pair of thigh straps.

21. The roping harness according to claim 19, further comprising at least an adjustment device configured to adjust a length of the first strap, the adjustment device being fixed to two of the second woven area, the two second woven areas being separated by the first woven area, the two second woven areas and the first woven area being aligned along the longitudinal axis of the first strap.

* * * * *